US006595444B2

(12) United States Patent
Schwelling

(10) Patent No.: US 6,595,444 B2
(45) Date of Patent: Jul. 22, 2003

(54) ATTACHMENT FOR PAPER SHREDDERS FOR RECEIVING AND FEEDING PRINTED MATTER

(76) Inventor: Hermann Schwelling, Hartmannweg 5, 88682 Salem (DE)

( * ) Notice: Subject to any disclaimer, the term of this patent is extended or adjusted under 35 U.S.C. 154(b) by 0 days.

(21) Appl. No.: 09/792,295

(22) Filed: Feb. 23, 2001

(65) Prior Publication Data

US 2002/0014547 A1 Feb. 7, 2002

(30) Foreign Application Priority Data

Feb. 24, 2000 (DE) ..... 100 08 742

(51) Int. Cl.[7] ..... B02C 18/22
(52) U.S. Cl. ..... 241/37.5; 241/224; 241/236
(58) Field of Search ..... 241/100, 236, 241/37.5, 285.2, 285.3, 224

(56) References Cited

U.S. PATENT DOCUMENTS 4,867,383 A * 9/1989 Terry et al. ..... 162/4

FOREIGN PATENT DOCUMENTS

DE 1240721 5/1967
DE 1941599 2/1971
DE 3112835 1/1983

* cited by examiner

*Primary Examiner*—Mark Rosenbaum
(74) *Attorney, Agent, or Firm*—Friedrich Kueffner

(57) ABSTRACT

The invention relates to an attachment for paper shredders for receiving and feeding printed matter, in particular, crumpled paper, as is found in wastepaper baskets and the like, as well as a method for filling a paper shredder by using the aforementioned attachment, wherein the paper shredder comprises a housing of a cabinet-like base and an optionally removable upper housing part, together with a cutting assembly arranged in the upper area of the housing, comprising cutting rollers and stripper bars as well as a correlated drive device, wherein above the cutting assembly a feed shaft for so-called crumpled paper is provided and the attachment is arranged above this feed shaft fixedly or optionally removably, wherein the attachment together with a covered, perforated upper area of the upper housing part forms a receiving chamber for so-called crumpled paper, and wherein this receiving chamber is in communication with the feed shaft, and it is especially provided that the attachment (11) has an integrated closure unit (20) which comprises movable or mobile parts, with which the fill opening (17) of the attachment (11) and the transition area between the receiving chamber and the feed shaft (10) can be alternatingly opened and closed.

13 Claims, 2 Drawing Sheets

ATTACHMENT FOR PAPER SHREDDERS FOR RECEIVING AND FEEDING PRINTED MATTER

BACKGROUND OF THE INVENTION

1. Field of the Invention

The invention relates to an attachment for paper shredders for receiving and feeding printed matter, in particular, crumpled paper, as it is found in wastepaper baskets and the like collecting containers.

2. Description of the Related Art

In practice, paper shredders are known which have a cabinet-type or cabinet-like base in which the cutting assembly for shredding the fed material is arranged above a collecting chamber. Feeding is carried out from the upper area wherein, in the so-called upper part of the housing, a substantially horizontally positioned or downwardly slanted slot for receiving smooth, sheet-like material is provided as well as, if desired, a receiving container—feed hopper—provided for so-called crumpled paper, for example, for the contents of a wastepaper basket, and detachably or fixedly arranged on the upper part.

These receiving containers are generally provided at the front, i.e., facing the operator, with a transparent front plate and have at their surface a fill opening which, in general, covers almost the entire surface area. The lower surface of these attachments is designed with respect to the constructive configuration relative to the upper surface of the upper part of the housing of the paper shredders such that the material that is filled in—for example, crumpled paper—can fall directly into the space in front of the cutting rollers. Depending on the make, it is furthermore provided that the cutting assembly, after actuation of a start button, runs continuously or, during filling of the crumpled material, the cutting assembly is started by actuation of a switch element, for example, a light barrier.

Such a paper shredder is, for example, the model "HSM P 450 CC". For preventing danger areas on this device, the safety regulations/standard, EN 294 of 1992 (European standard), requires that, as a function of the position of the danger areas, i.e., in these devices the position of the cutting assembly of the paper shredder, the upper edge of the receiving container, measured from the foot print area of the paper shredder, must have a certain minimum height in the vertical direction.

This has the consequence that, for example, in the case of an arrangement of the cutting assembly at a height of 1000 mm and of a spacing of the feeding edge for the material to be destroyed of 300 mm, in general, from the front side of the paper shredder, the upper edge of the receiving container must have a height of at least 1600 mm.

Accordingly, these devices are very tall so that a great material expenditure for the manufacture of such paper shredders is the result, or the paper shredders which are built to a height below the height limit values determined by the standard must have additional safety features at the fill opening of the aforementioned receiving container.

For example, in the paper shredder "IDEAL 4605" (see copy of brochure according to attachment 2) a railing is provided laterally and rearwardly at the upper edge of the receiving container; the foldable material receiving table for the sheet-like material ensures the safety spacing from the filling side in this device.

According to a further known solution, the paper shredder "TAROS 50.66", the fill opening of the receiving container is secured by a lid positioned at the top which actuates a safety switch when opened. The solution requires further material and circuit-technical expenditures and additional labor for the operator when feeding the aforementioned crumpled material.

In a further paper shredder, the model "5540 C", the housing of the paper shredder is relatively low relative to the aforementioned paper shredders but, on the other hand, this paper shredder projects very far laterally. This paper shredder has laterally positioned feed inlets, i.e., an insertion slot for sheet-like material and a receiving box, spaced laterally farther outwardly from it, into which the so-called crumpled paper can be emptied which is then guided via a covered transport belt to the cutting assembly. The spacing of this feeding location to the cutting assembly depends on the height of the through gap for the crumpled material, i.e., the spacing from the transport belt vertically in the upward direction to the cover. This solution also requires much material for the manufacture of the paper shredder; moreover, the required foot print area is much greater in comparison to the paper shredders having a vertical extension.

SUMMARY OF THE INVENTION

Accordingly, the object of the invention is to provide an attachment for paper shredders which is arranged fixedly or optionally on a paper shredder with which a paper shredder together with the positioned attachment, while complying with the safety regulations prescribed by the standard, has a relatively low total device height in comparison to the known devices despite a minimal foot print area.

This object is solved for an attachment for paper shredders for receiving and feeding printed matter, in particular, of so-called crumpled material, with an attachment which has an integrated closure unit provided with movable or mobile parts with which the fill opening of the attachment and the transition area between the receiving chamber and the feed shaft are opened and closed alternatingly, and means for actuating and controlling the closure unit.

The advantages of the invention reside primarily in that, for a minimal foot print area of the paper shredder, it has a minimal device height relative to the aforementioned known paper shredders, wherein this device height must depend substantially only on the desired container volume of the collecting chamber for the shredded material.

This novel attachment, which receives the aforementioned so-called crumpled paper and feeds it to the cutting assembly, is configured in this connection particularly such that an accidental insertion of the hand through the receiving chamber of the attachment into the cutting assembly cannot occur, wherein, however, waste material can be filled or refilled into the receiving chamber of the attachment even when the cutting assembly is in operation.

Moreover, the novel attachment has the advantage that the waste material supplied for shredding, for example, crumpled paper and the like material of an office wastepaper basket, can be supplied by metered feeding into the cutting assembly.

The novel attachment is characterized, in particular, in that it comprises a closure unit, wherein the closure units itself or individual parts or structural components thereof are movable, in particular, are rotatable or mobile. By means of this closure unit, a fill opening of the attachment and a transition area (opening) between the material receiving chamber and the feed shaft to the cutting assembly can be opened and closed, in particular, simultaneously, such that an accidental insertion of the hand through the receiving chamber of the attachment into the cutting assembly cannot occur.

The paper shredder, onto which the attachment for receiving and feeding printed matter is primarily to be placed, has preferably a housing whose lower area has a cabinet-like base and whose upper area is a preferably optionally removable upper housing part, together with the cutting assembly arranged in the upper area of the housing, with cutting rollers and stripper bars, as well as a correlated drive device, wherein above the cutting assembly a feed shaft for the so-called crumpled paper is provided.

The attachment is arranged fixedly or optionally removable above this feed shaft on the housing, wherein the attachment essentially forms together with a covered, perforated upper area of the upper housing part a receiving chamber for the so-called crumpled paper and wherein this receiving chamber is in communication with the feed shaft. The mobile or movable closure unit or components thereof have correlated therewith means for their actuation and control.

In particular, it is provided that the closure unit comprises a movable closing element which is preferably arranged to be rotatable about a horizontal axis; if needed, it can also be rotated about a vertical axis.

The movable closing element of the closure unit is especially a cylindrical base member in which, by cutting out half the mantle surface, a receiving trough is formed which is arranged so as to be horizontally rotatable about the longitudinal axis of its body.

According to a further embodiment, the movable closing element of the closure unit is a cylindrical hollow body which is arranged so as to be rotatable vertically about the longitudinal axis of its body, wherein this hollow body has an opening in its mantle surface which matches the opening provided in the front surface of the attachment and comprises a further opening in its mantle surface, wherein these openings both provided in the hollow body are staggered relative to one another such that also in this context the feed shaft above the cutting assembly is closed when the front surface of the attachment—in the position filling—is open.

The hollow body can also have a shape deviating from that of a cylinder; the basic shape of the body can be a cube, a parallelepiped, a column or a prism, wherein at least two openings are provided and one of these openings is correlated with the opening in the front surface of the attachment and the other opening is correlated with the feed shaft.

Another development provides that the movable closing element is arranged slidably in a vertical and/or horizontal plane or a plane which extends at a slant between the aforementioned planes.

Moreover, the movable closing element can be comprised of two parts which are coupled with one another, wherein one part of the movable closing element is movable in the vertical direction and the other part is moveable in the horizontal direction or in a plane arranged at a slant. Preferably, one of these parts is correlated with the opening in a front surface of the attachment and the other part is correlated with the feed shaft arranged in the upper part of the housing.

The invention is also characterized by a method for filling of a paper shredder by using an attachment for paper shredders, wherein, according to the novel method steps, the closing action of the opening in the front surface of the attachment and the opening action of the feed shaft are carried out simultaneously.

A further development of the method suggests that the closing action of the opening in the front surface of the attachment and the opening action of the feed shaft are carried out simultaneously and continuously progressively.

According to a further development of the method, it is provided that the closing action of the opening in the front surface of the attachment and the opening action of the feed shaft are carried out simultaneously and acceleratingly progressively.

Moreover, according to a further embodiment, it is provided that the closing action of the opening of the front surface of the attachment and the opening action of the feed shaft are carried out simultaneously and deceleratingly progressively.

According to a special method embodiment, it is provided that the closing action of the opening in the front surface of the attachment and the opening action of the feed shaft are carried out simultaneously and progressively in intervals.

BRIEF DESCRIPTION OF THE DRAWINGS

The invention will be explained in more detail in the following with a preferred embodiment schematically illustrated in the drawings. The drawings show, respectively.

DETAILED DESCRIPTION OF THE INVENTION

Figure 1:
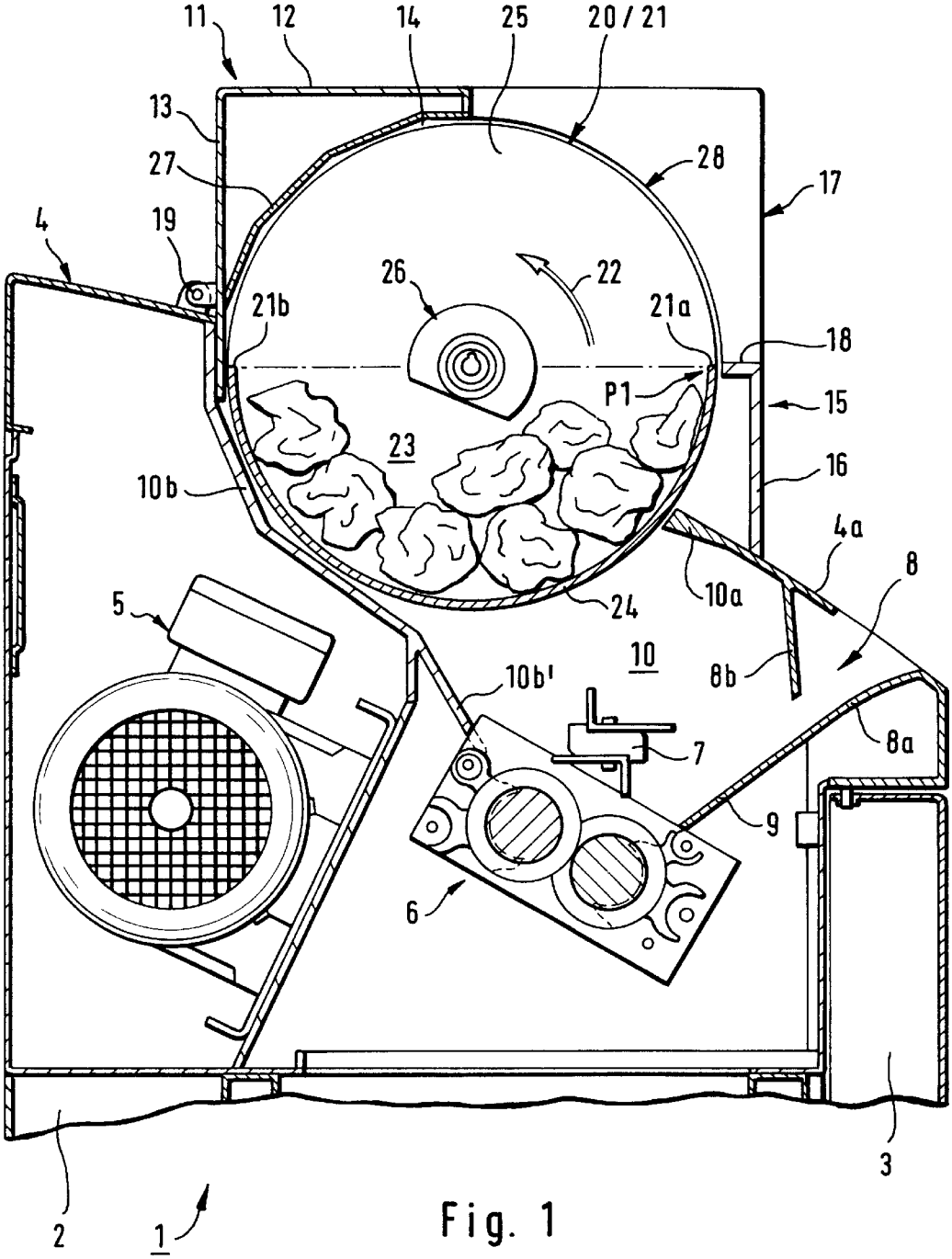
FIG. 1 the upper area of a partially sectioned paper shredder in a side view with the novel attachment placed thereon and positioning of the closure unit in a first position.
Figure 2:
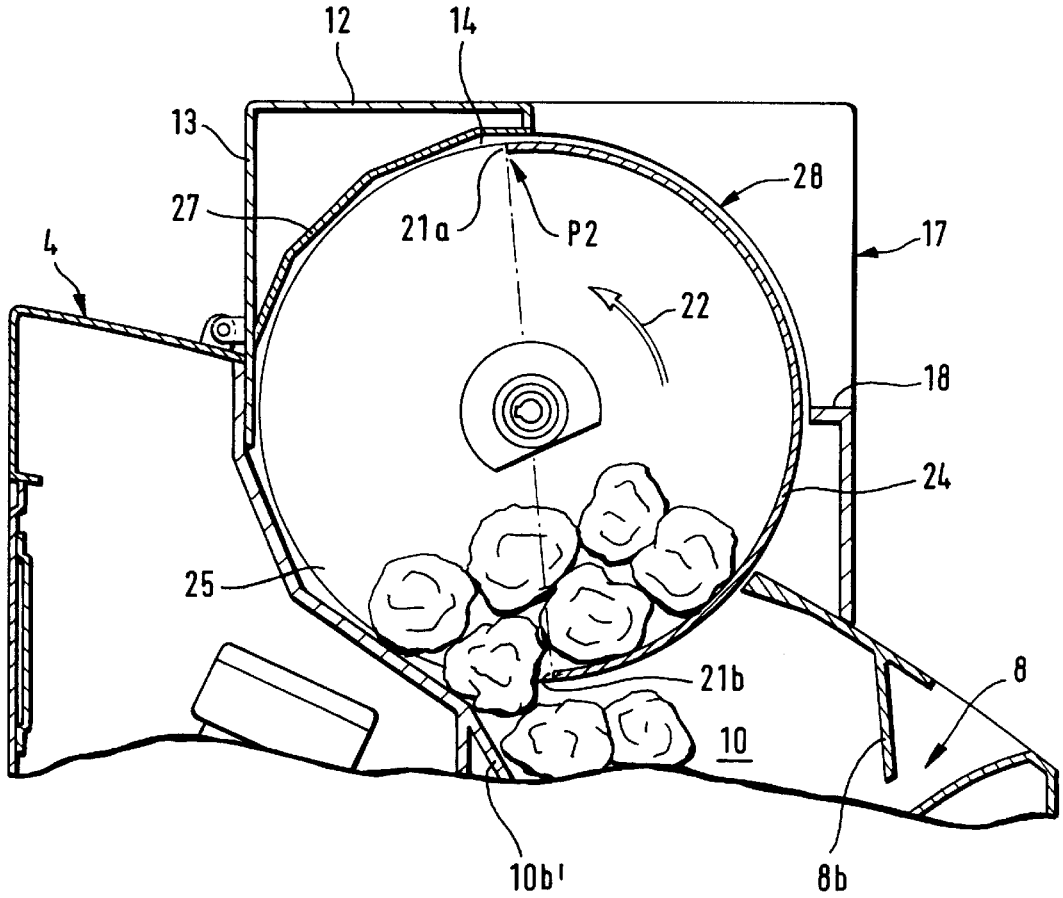
FIG. 2 a detail of FIG. 1 with position of the closure unit in a second position.

The constructive and essential details of the illustrated advantageous embodiment of the novel attachment with integrated closure unit are illustrated in FIGS. 1 and 2; the corresponding identification of the components can be taken essentially from the list of reference numerals.

FIG. 1 shows a paper shredder 1 in a partially sectioned illustration of its upper housing part. In this embodiment, the cutting assembly 6 with cutting rollers and stripper bars as well as a correlated material loosening device 7 are arranged in the upper area of a cabinet-like base 2. The cutting assembly 7 has correlated therewith a drive device 5. In the forward area 4*a* of the upper housing part 4 a feed slot 8 with the boundary surfaces 8*a* and 8*b* is arranged which has a transition into a gliding surface 9 which ends in this embodiment directly before the cutting assembly 6. Via this feed slot the sheet-like material is introduced into the paper shredder. Above the cutting assembly 6, in this Figure to the left of the feed slot 8, a feed shaft 10 is provided which is delimited by a front surface 10*a* arranged in the upper housing part 4 and a rearward surface 10*b* as well as sidewalls of the upper housing parts 4, not specifically identified. The end area 10*b*' of the rearward surface 10*b*' ends directly at the cutting assembly 6. A partial area of the upper housing part 4 above the feed shaft 10 is cut out; in this area, the novel attachment 11 is placed and fastened with its back wall 13 by means of a hinge 19 on the upper housing part 4 so that the attachment 11 can be pivoted to the back, if desired.

For necessary repair or maintenance work, for example, in order to be able to remove material that cannot be cut, the attachment 11 is pivoted to the back, wherein a safety switch, not illustrated, will interrupt operation of the cutting assembly.

The closure unit 20 integrated in the attachment 11 is provided with a movable closure element 21 that is essentially comprised of a horizontally rotatably arranged receiving trough 23. The rotational axis, not identified, of this receiving trough 23 is rotatably supported in bearings 26, wherein the bearings 26 are fastened on the sidewalls 14 of the attachment 11.

In the filling position P1, illustrated in FIG. 1, the half shell 24 of the receiving trough 23 is in its lower position and closes the inlet for the feed shaft 10 which inlet is arranged between the components 10*a* and 10*b*.

In this position P1, the receiving trough 23 can be filled via the opening 17 which is provided in the front surface 15 of the attachment 11 and extends partially into the upper surface 12 of the attachment 11.

The lower forwardly positioned closed front surface 16 is angled inwardly at the level of the forward edge 21 of the movable closing element 21, here the receiving trough 23, so that an upper edge 18 is formed which is spaced with a small gap from the outer surface of the receiving trough.

Once the receiving trough 23, which is delimited laterally by sidewalls 25 forming a full circle, is filled, the receiving trough 23 is rotated by a non-illustrated actuating element in the direction of arrow 22. When doing so, the opening 17 in the front surface 15 of the attachment 11 is closed and the feed shaft 10, positioned above the cutting assembly 6, is increasingly opened by the rearward edge 21*b* of the movable closing element 21, here the receiving trough 23. When reaching a position P2, shown in FIG. 2, the feed shaft 10 is open approximately half way.

At the forward edge 21*a* as well as at the rearward edge 21*b* of the movable closing element 21, stop elements, not illustrated, are provided such that these edges 21*a* and 21*b* do not go past the upper edge 18 of the lower closed front surface 16 so that an accidental hand insertion into the feed shaft to the cutting assembly is prevented.

It should also be noted that, according to the invention, in the course of the method according to the invention during the closing process the forward lower body edge of the closing element 21 in the movement direction—arrow 22—is substantially moved upwardly or upwardly and rearwardly, wherein the movement/rotation is preferably not greater than 180° C. and the pivot action is not revolving or rotating.

All of the features mentioned in the above description as well as the features disclosed only in the drawing are further components of the invention even though they are not especially emphasized and particularly mentioned in the claims.

The invention is not limited to do described embodiment but can be varied in many ways within the context of the disclosure.

List of Reference Numerals

1 paper shredder
2 cabinet-like base
3 front door
4 upper housing part (optionally or partially removable)
5 drive device
6 cutting assembly (with cutting rollers and stripper bars)
7 material loosening device
8 feed slot
8*a*, 8*b* boundary surfaces
9 gliding surface
10 feed shaft
10*a* forward surface
10*b* rearward surface
10*b'* end area
11 attachment
12 upper surface
13 back wall
14 right lateral surface (interior)
15 front surface
16 lower, closed front surface
17 opening, in component 15
18 upper edge of component 16, inwardly angled
19 hinge
20 closure unit
21 movable closing element
21*a* forward edge
21*b* rearward edge
22 direction of movement
23 receiving trough
24 half shell
25 sidewall (full circle)
26 rotatable support
27 boundary wall
28 screen
P1 position 1
P2 position 2

What is claimed is:

1. Attachment in combination with a paper shredder for receiving and feeding printed matter, wherein the paper shredder comprises a housing of a cabinet-like base and an optionally removable upper housing part, including a cutting assembly arranged in an upper area of the housing, with cutting rollers and stripper bars as well as a correlated drive device, wherein above the cutting assembly a feed shaft for so-called crumpled paper is provided and the attachment is fixedly or optionally removably arranged above this feed shaft, wherein the attachment together with a covered, perforated upper area of the upper housing part provides a receiving chamber for so-called crumpled paper, and wherein this receiving chamber is in communication with the feed shaft, wherein the attachment (11) has an integrated closure unit (20), which comprises movable or mobile parts, with which the fill opening (17) of the attachment (11) and the transition area between the receiving chamber and the feed shaft (10) are opened and closed alternatingly, further comprising means for actuating and controlling the closure unit (20).

2. Attachment for paper shredders according to claim 1, wherein the closure unit (20) has a movable closing element (21).

3. Attachment for paper shredders according to claim 2, wherein the movable closing element (21) is rotatable.

4. Attachment for paper shredders according to claim 3, wherein the movable closing element (21) of the closure unit (20) comprises a cylinder-shaped base member having a mantle surface, wherein a receiving trough (23) is formed in the base member by cutting out approximately half of the mantle surface thereof, which receiving trough is horizontally rotatably arranged about the longitudinal axis of its body.

5. Attachment for paper shredders according to claim 3, wherein the movable closing element (21) of the closure unit (20) is a cylindrical hollow body which is arranged vertically rotatably about the longitudinal axis of its body, wherein this hollow body has an opening in its mantle surface corresponding with the opening (17) provided in the front surface (15) of the attachment (11) and comprises a further opening in the body surface positioned in the hollow body are arranged in a staggered arrangement relative to one another such that the feed shaft (10) positioned above the cutting assembly (6) is closed when the front surface (15) of the attachment (11) is open.

6. Attachment for paper shredders according to claim 3, wherein the movable closing element (21) essentially formed as a hollow body has a body shape different from that of a cylinder.

7. Attachment for paper shredders according to claim 3, wherein the movable closing element (21) is rotatable about a horizontal axis.

8. Attachment for paper shredders according to claim 3, wherein the movable closing element (21) is rotatable about a vertical axis.

9. Attachment for paper shredders according to claim 2, wherein the movable closing element (21) is slidable in a substantially vertical plane.

10. Attachment for paper shredders according to claim 9, wherein the movable closing element (21) is comprised of two parts, which are coupled with one another, wherein one part of the movable closing element (21) is slidable in the vertical plane and the other part of the movable closing element (21) is slidable in the horizontal plane of wherein both parts are slidable together in one plane or alone, respectively, in separate planes arranged slantedly.

11. Attachment for paper shredders according to claims 10, wherein a part of the movable closing element (21) is correlated with an opening (17) in a front surface (15) of the attachment (11) and the other part of the movable closing element (21) is correlated with the feed shaft (10) arranged in the upper housing part (4).

12. Attachment for paper shredders according to claim 2, wherein the movable closing element (21) is slidable in a substantially horizontal plane.

13. Attachment for paper shredders according to claim 2, wherein the movable closing element (21) is slidable in a plane extending substantially slantedly between a vertical plane and a horizontal plane.

* * * * *